US006765464B2

(12) United States Patent
Pietsch et al.

(10) Patent No.: US 6,765,464 B2
(45) Date of Patent: Jul. 20, 2004

(54) ELECTROMAGNETIC SWITCHING RELAY AND METHOD FOR ACCURATE ARRANGEMENT OF A MAGNETIZING COIL IN AN ELECTROMAGNETIC SWITCHING RELAY

(75) Inventors: Karsten Pietsch, Berlin (DE); Lutz Woske, Berlin (DE)

(73) Assignee: Tyco Electronics AMP GmbH (DE)

( * ) Notice: Subject to any disclaimer, the term of this patent is extended or adjusted under 35 U.S.C. 154(b) by 0 days.

(21) Appl. No.: 10/222,727

(22) Filed: Aug. 16, 2002

(65) Prior Publication Data

US 2004/0032310 A1 Feb. 19, 2004

(30) Foreign Application Priority Data

Aug. 16, 2001 (DE) ..... 101 40 142

(51) Int. Cl.[7] ..... H01H 67/02
(52) U.S. Cl. ..... 335/129; 335/128; 335/130
(58) Field of Search ..... 335/78–86, 124, 335/128–131

(56) References Cited

U.S. PATENT DOCUMENTS 5,568,108 A * 10/1996 Kirsch ..... 335/130

FOREIGN PATENT DOCUMENTS

DE 1992074 A1 7/2000

* cited by examiner

*Primary Examiner*—Lincoln Donovan

(57) ABSTRACT

An electromagnetic switching relay having a base member and a magnetized coil. The base member having first guide elements. The magnetized coil having a terminal and second guide elements positioned substantially between the first guide elements that engage the first guide elements. A partition layer that allows displacement of the magnetizing coil relative to the base member before the second guide elements engage the first guide elements and fixes the second guide elements to the first guide elements when the base member and the magnetized coil are pushed toward each other.

12 Claims, 5 Drawing Sheets

ELECTROMAGNETIC SWITCHING RELAY AND METHOD FOR ACCURATE ARRANGEMENT OF A MAGNETIZING COIL IN AN ELECTROMAGNETIC SWITCHING RELAY

BACKGROUND OF THE INVENTION

The invention relates to an electromagnetic switching relay. More particularly, the invention relates to an electromagnetic switching relay having guide elements that accurately align a magnetising coil with a base member to ensure proper spacing for an armature to interact with a switch contact.

DESCRIPTION OF THE PRIOR ART

Conventional electromagnetic switching relays have a base member on which a magnetising coil, a magnet core, a yoke and an armature are arranged. The armature interacts with a switch contact that is adjustable between a contact position in which the switch contact connects a first and a second terminal, and a release position in which the switch contact disconnects the first and the second terminal as a function of a current flowing through the magnetising coil. Electromagnetic switching relays of this type are known in the most varied of embodiments and are used, for example, in motor vehicle engineering. The known switching relays differ, in particular, with regard to the manner in which the mechanical relay parameters thereof are adjustable.

The described relays may comprise a magnetic bistable as well as a monostable magnetic circuit. Two switching positions with open and closed contacts are held by spring magnet or permanent magnet forces resulting from the insertion of a permanent magnet into the magnetic circuit. If the contacts are closed, the magnetic retention forces are generated by a permanent magnet in the bistable type or by the current-carrying coil in the monostable relay. The bistable magnetic circuit is weakened or strengthened by means of magnetic coils with opposite magnetic orientation, in order to obtain alternating switching positions. This is achieved by means of two coils with opposite windings or by electrical polar reversal.

One example of an electromagnetic relay having adjustable mechanical relay parameters is disclosed in DE 199 20 742 A1. DE 199 20 742 A1 teaches an electromagnetic relay having a base member, a magnet system and an armature spring. The magnet system has an armature on which two lever portions are formed constituting the support points for the armature spring. A further support point for the armature spring is located on a fixed relay portion. By bending the fixed relay portion the armature and, therefore, the contact spacing can be adjusted.

Because of unavoidable manufacturing tolerances, the spacing between the switch contact and the terminals does not correspond exactly to a desired value, but rather is subject to manufacturing-based variations. As a result, individual and generally manual adjustment of the contact spacing is required wherein, for example, either the magnet core is indented or a contact spring connected to the armature is bent. These known methods are time consuming and complex, and there is a risk that the adjusted contact spacing and overtravel will not remain constant, for example, owing to an elastic recovery from the plastic region of the contact spring.

It is therefore desirable to provide an electromagnetic switching relay that is simple in design and allows reliable and constant adjustment of contact spacing and overtravel for accurate arrangement of a magnetising coil with respect to the fixed contacts.

SUMMARY OF THE INVENTION

The invention relates to an electromagnetic switching relay having a base member and a magnetised coil. The base member having first guide elements. The magnetised coil having a terminal and second guide elements positioned substantially between the first guide elements that allow displacement of the magnetising coil relative to the base member and engage the first guide elements to fix the magnetising coil relative to the base member.

The invention further relates to a method for accurately arranging a magnetising coil in an electromagnetic switching relay. The magnetising coil is positioned relative to a base member by displacing the magnetising coil along first guide elements on either side of the base member and the magnetising coil. The magnetising coil is fixed relative to the base member by exerting a vertical pressure force on a partition layer by the magnetising coil or the base member.

An advantageous embodiment comprises a partition layer that is in one piece with a base member plate.

In a preferred embodiment the partition layer is incorporated at opposite longitudinal sides of a shaft. Preferably, the partition layer is a surrounding rim in a shaft of the base member plate.

In another preferred embodiment the guide elements have the shape of locking runners, whereby one locking runner comprises at least one longitudinal strut and one transversal strut.

Furthermore, it is advantageous to provide several transversal struts which are incorporated in opposite position at two longitudinal sides of the longitudinal strut.

The transversal struts preferably comprise a slanted plane which is inclined in an upward direction towards the longitudinal strut. The slanted plane allows for low-force locking between the transversal struts and the partition layer.

DETAILED DESCRIPTION OF THE PREFERRED EMBODIMENT

Figure 1:
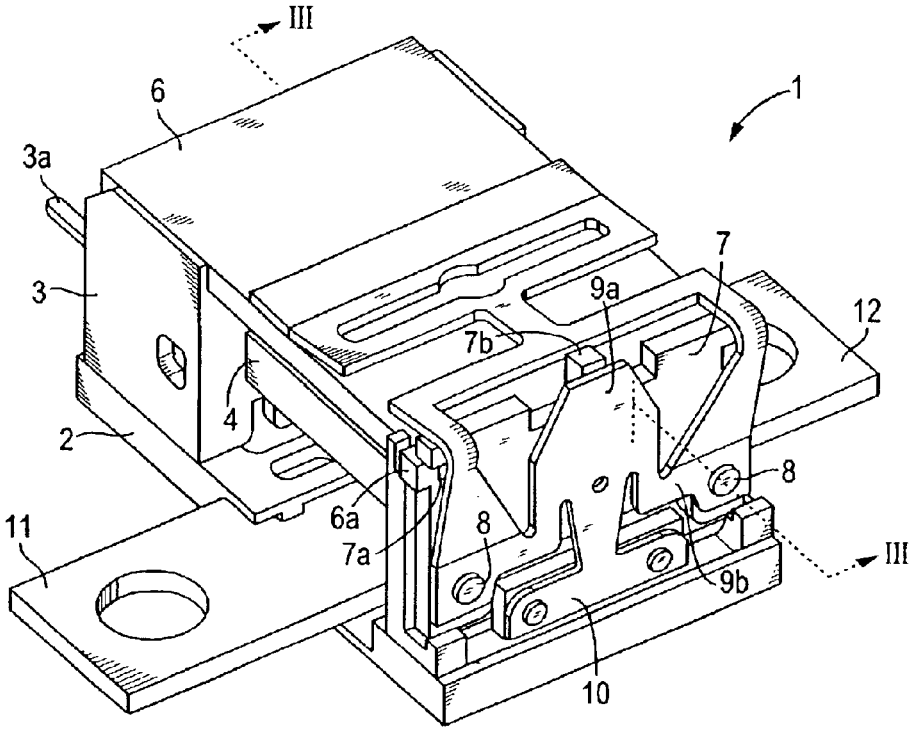
FIG. 1 is a top perspective view of an electromagnetic switching relay according to the invention shown without a housing.
Figure 2:
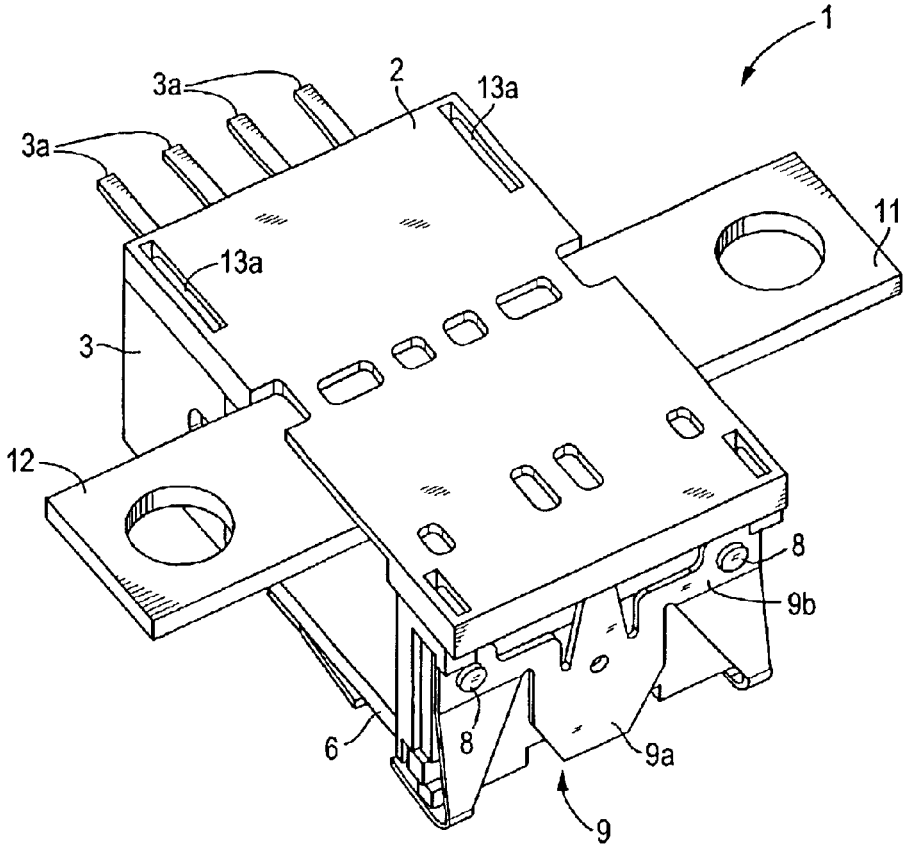
FIG. 2 is a bottom perspective view of the switching relay of FIG. 1.
Figure 3:
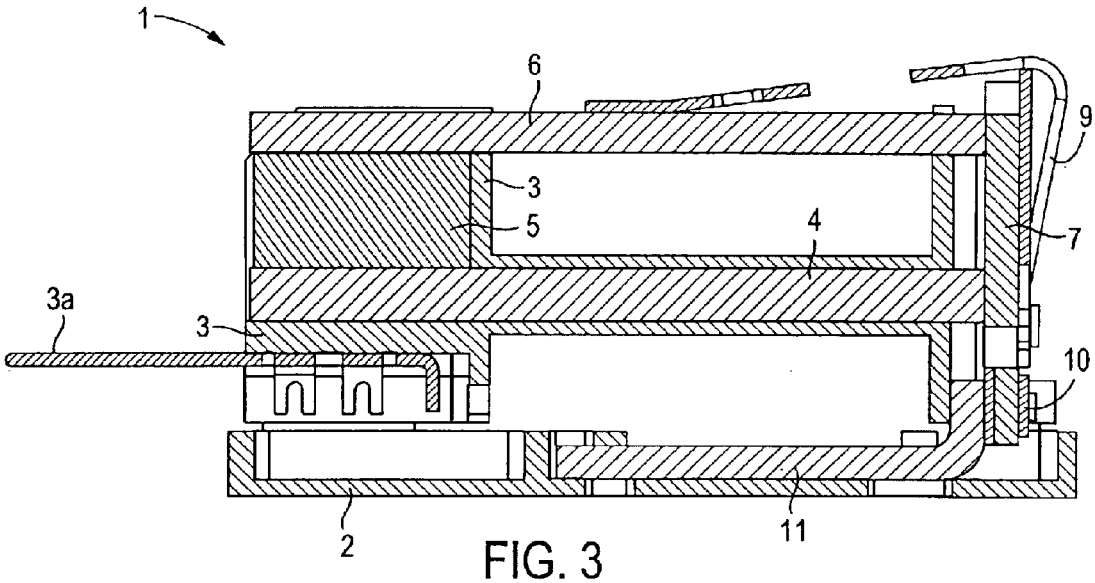
FIG. 3 is a schematic view along line III—III of FIG. 1.

FIGS. 1 and 2 show an electromagnetic switching relay 1. The electromagnetic switching relay 1 comprises a base member 2 having terminals 3*a*, 11, 12, a magnetising coil 3, a yoke 6, an armature 7 and a magnet core 4. As shown in FIG. 3, the magnet core 4 is positioned between the magnetising coil 3 and adjacent to a permanent magnet 5. The yoke 6 is substantially adjacent to the permanent magnet 5 and extends parallel to the magnet core 4. The yoke 6 rests upon a portion of the magnetising coil 3 and has yoke mandrels 6*a* extending therefrom. The armature 7 is positioned adjacent to the yoke mandrels 6*a* and at a leading end of the magnetising coil 3 opposite from the permanent magnet 5.

As shown in FIGS. 1 and 2, the armature 7 has bearing recesses 7*a*, an armature tongue 7*b* and a contact spring 9. The bearing recesses 7*a* are provided at an upper lateral edge region of the armature 7 for receipt of the yoke mandrels 6*a*. The yoke mandrels 6*a* are arranged such that the armature 7 is mounted on the leading end of the magnetising coil 3 and is supported on the yoke mandrels 6*a*.

As shown in FIGS. 1 and 2, the contact spring 9 is designed as a cruciform leaf spring having an integrally formed first leg 9*a* and second leg 9*b*. The first leg 9*a* has a first free end connected to the armature tongue 7*b* and a second free end having a contact bridge 10. The contact spring 9 presses the contact bridge 10 to contact faces of terminals 11, 12 as a function of the position of the armature 7. The second leg 9*b* has elastic spring arms that extend from the first leg 9*a* that have free ends rigidly connected to the armature 7 by riveted joints 8.

Figure 4A:
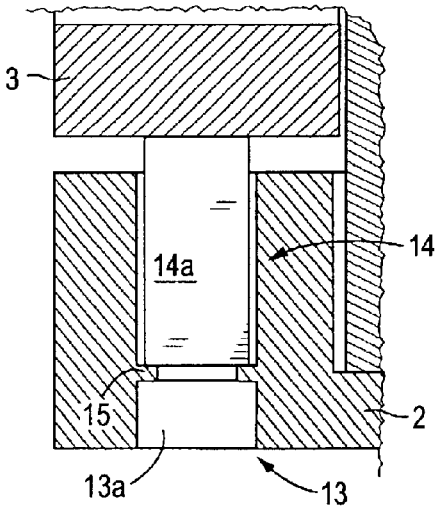
FIG. 4*a* is a schematic diagram showing guide elements of a magnetising coil and a base member during positioning.
Figure 4B:
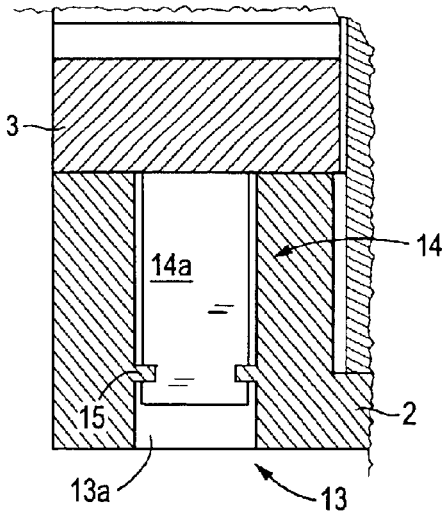
FIG. 4*b* is a schematic diagram showing the guide elements of the magnetising coil and the base member in a fixed position.

As shown in FIGS. 4*a* and 4*b*, the base member 2 and the magnetising coil 3 have guide elements 13, 14, respectively. The guide elements 13 of the base member 2 are designed as shafts 13*a* formed in the longitudinal direction of the base member 2. The guide elements 14 of the magnetising coil 3 are formed as runners 14*a* on the lower side of the magnetising coil 3 facing the base member 2. The runners 14*a* engage the shafts 13*a*.

As shown in FIG. 4*a*, *a* partition layer or a type of film skin 15 is provided between the guide elements 13, 14, 13*a*, 14*a*. The partition layer 15 is provided on either side of the guide elements 13, 14, 13*a*, 14*a* and is formed in such a way that the partition layer 15 irreversibly deforms or partially tears as soon as a vertical pressure force is exerted on the partition layer 15 via the base member 2 and/or the magnetising coil 3. In addition to fixing of the magnetising coil 3 by deforming or tearing the partition layer 15, it is possible to further fix the guide elements 13, 14 by a further fixing means, for example, casting the shafts 13*a* with a hardening material.

The attachment of the magnetising coil 3 to the base member 2 will now be described in greater detail with reference to FIGS. 4*a* and 4*b*. As shown in FIG. 4*a*, the runners 14*a* of the magnetising coil 3 are placed adjacent to the shafts 13 of the base member 2 such that the magnetising coil 3 can be displaced horizontally relative to the base member 2. Once the magnetising coil 3 is arranged in the correct position relative to the base member 2, the magnetising coil 3 is fixed in position by applying a vertical pressure force on the partition layer 15 by the base member 2 and/or the magnetising coil 3 to cause the runners 14*a* to penetrate the partition layer 15. As shown in FIG. 4*b*, the partition layer 15 formed between the guide elements 13, 14, 13*a*, 14*a* irreversibly deforms or partially tears as soon as the vertical pressure force is exerted on the partition layer 15 to fix the magnetising coil 3 in position and limit horizontal displacement.

The operation of the electromagnetic switching relay 1 will now be described in greater detail with reference to FIGS. 1 through 3. As the armature 7 rests on the yoke mandrels 6*a*, the armature 7 tilts about an axis formed by the upper side of the yoke 6. As shown most clearly in FIG. 3, in a rest position, the armature 7 is pulled by the permanent magnet 5 in the direction of the magnetising coil 3 such that the contact spring 9 is also in a rest position. In the rest position the contact bridge 10 rests on the contact faces of the terminals 11, 12 to produce an electrical connection between the terminals 11, 12. The electromagnetic switching relay shown in FIG. 3 is a bistable relay. Depending on the embodiment, the relay may also be constructed as a monostable switching relay without a permanent magnet 5.

When the magnetising coil 3 is supplied with a current, through the terminals 3*a*, *a* magnetic field is produced compensating the holding force of the permanent magnet 5 of the armature 7. The armature 7 is, therefore, no longer pulled by a magnetic field toward the magnet core 4 and the bearing faces of the terminals 11, 12. Consequently, the contact of the armature 7 on the magnet core 4 is broken by the contact spring 9 as the contact bridge 10 of the armature 7 pivots away from the magnet core 4. As a result, the electrical connection between the contact bridge 10 and the terminals 11, 12 is interrupted.

Advantageously, the arrangement of the guide elements 13, 13*a*, 14, 14*a* and of the partition layer 15 between the guide elements 13, 13*a*, 14, 14*a* allows accurate positioning and durable fixing of the magnetising coil 3 relative to the base member 2. Accurately positioning the magnetising coil 3 relative to the base member 2 ensures that the contact spacing between the contact bridge 10 and the contact faces of the terminals 11, 12 is large enough that the magnet core 4 magnetised by the permanent magnets 5 can attract the armature 7 and detract the armature 7 as a function of the current flowing through the magnetising coil 3.

This arrangement of the magnetising coil 3 is also important in electromagnetic switching relays 1 without the permanent magnet 5 wherein the contact bridge 10 is at a distance from the terminals 11, 12 in the state without current, and a magnetic field is only produced when current flows through the magnetising coil 3 to cause the armature 7 and, therefore, the contact bridge 10 to be pulled toward the magnetic core 4 and the contact faces of the terminals 11, 12.

In a simple embodiment it is sufficient to provide guide elements 13 that interact with the partition layer 15. In this embodiment, it is not necessary to provide shafts as guide element.

Figure 5:
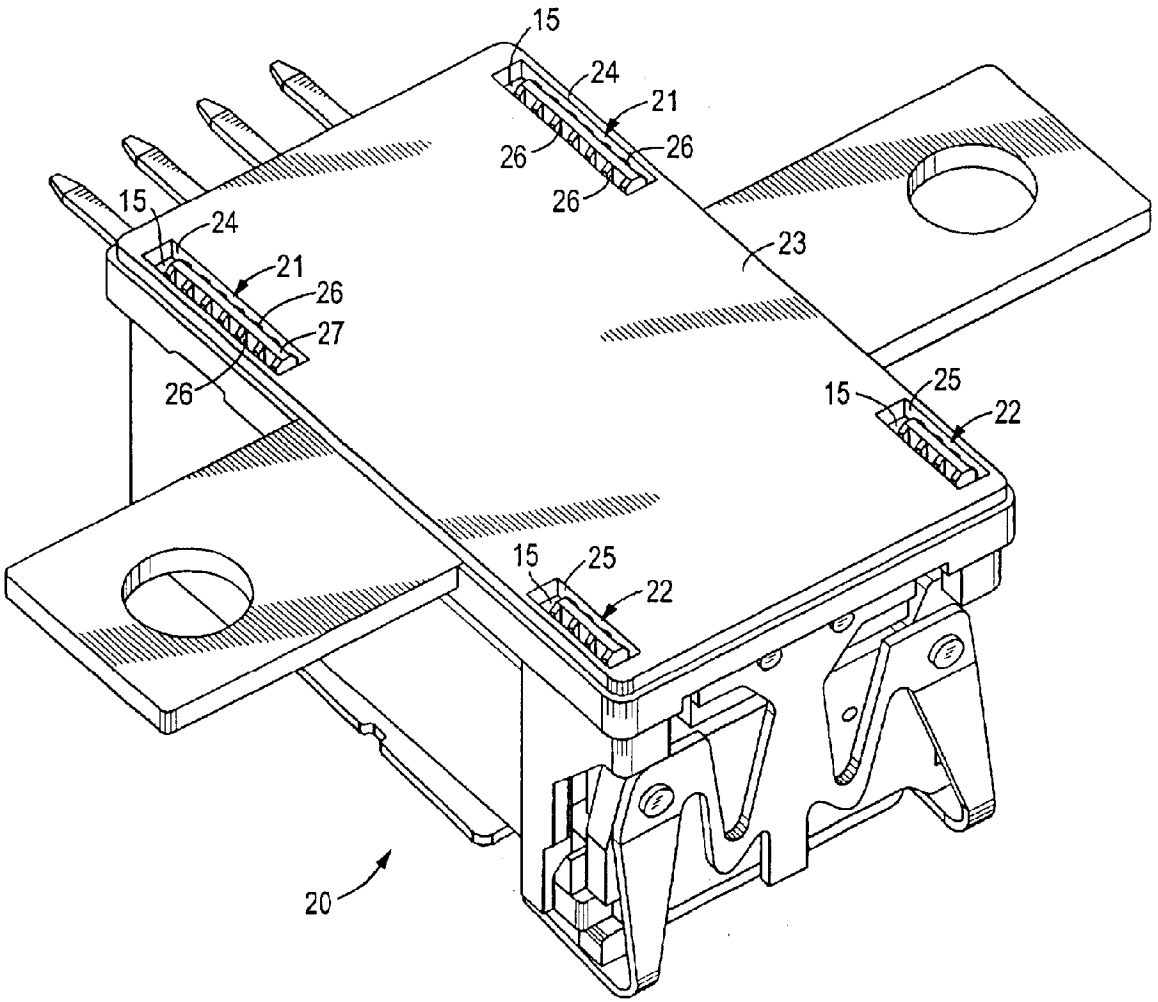
FIG. 5 is a further embodiment of the switching relay with a base member plate.

FIG. 5 shows a bottom view of another embodiment of the invention with a further switching relay 20 with a base member plate 23. Near its electrical terminals, the base member plate 23 incorporates first shafts 24 arranged at opposite longitudinal edges. The cross-section of the first shafts 24 is essentially rectangular and they are arranged alongside the longitudinal side of the base member plate 23. From the upper side of the base member plate 23 first locking runners 23 are inserted into the first shafts 24. First locking runners 21 comprise a longitudinal strut 27 and several transversal struts 26. The longitudinal strut 27 is arranged alongside the first shaft 24. The transversal struts 26 are arranged at right angles to the longitudinal direction of the longitudinal strut 27. Preferably, two transversal struts 26 are provided on opposite sides at the longitudinal strut 27. The first shafts 24 comprise a partition layer 15 at each longitudinal side. This partition layer has the shape of a longitudinal strip. In this manner, two facing partition layers 15 in the shape of longitudinal strips are arranged at the longitudinal sides of the first shafts 24. The partition layers 15 are preferably in one piece with the base member plate 23. Preferred materials are synthetics which provide the thickness required for the rigidity of the base member plate 23, but can also be produced as a thin layer to allow for the desirable characteristics of the partition layer 15. An essential function of the partition layer 15 is the locking of the first locking runners 21, which is achieved by pressing down the first locking runners 21. In this process, the transversal struts 26 create a deadlock of the first locking runner 21 with the partition layer 15. Alternatively, they may also cut open the partition layer 15 in the area of the transversal struts 26, thereby resulting in a form-closed interlocking between the transversal struts 26 and the cutup partition layer 15.

At one edge of the base member plate 23 belonging to the armature, two second shafts 25 are incorporated into the base member plate 23. The cross-section of the second shafts 25 is also rectangular and the second shafts 25 are arranged in their longitudinal direction alongside the longitudinal sides of the base member plate 23. The second shafts 25 also comprise partition layers 15 on their insides. The partition layers 15 have the shape of marginal strips. Contrary to the first shafts 24, the second shafts 25 are shorter. From the upper side of the base member plate 23, second locking runners 22 are inserted into the second shafts 25. The second locking runners 22 are also shorter than the first locking runners 21. The second locking runners 22 also comprise a longitudinal strut 27 and transversal struts 26 and have the same shape as the first locking runners 21.

Figure 6:
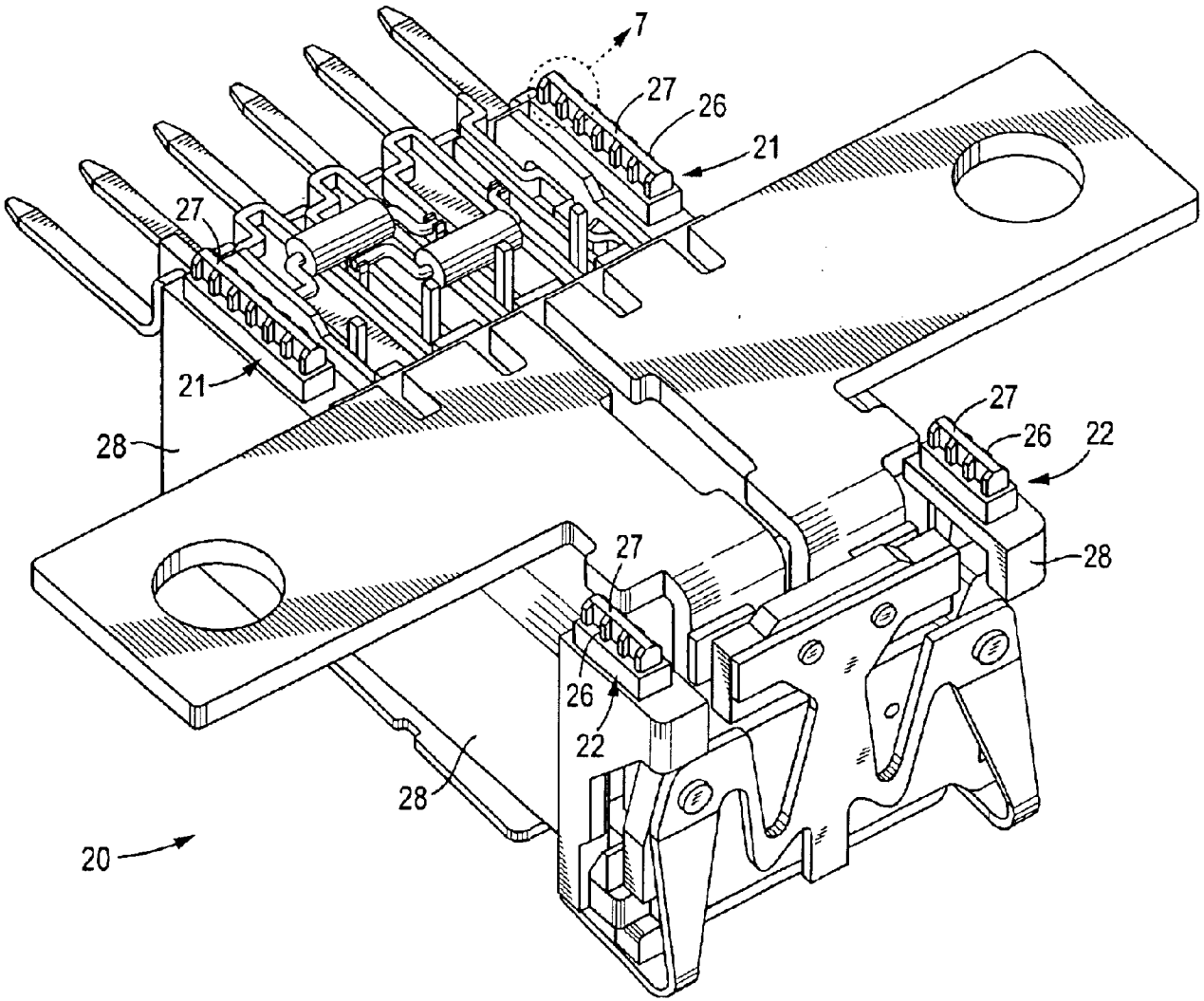
FIG. 6 is another switching relay without a base member plate with locking runners.

FIG. 6 shows a bottom view of a further switching relay 20 without the base member plate 23. The further switching relay comprises a relay casing 28, which comprises at four corners of its bottom side the two first locking runners 21 and the second two locking runners 22. This view clearly shows the shape of the longitudinal struts 27 as well as the shape of the transversal struts 26. The top plane of the first and the second locking runner 21, 22 is indicated by an end plane 29 of the longitudinal strut 27. The transversal struts 26 exhibit a slanted section at their upper end which is directed upwards towards the end plane 29 of the longitudinal strut 27.

The first and second locking runners 21 incorporate several transversal struts 26 on both longitudinal sides of the longitudinal strut 27. In a simple embodiment, however, it is sufficient to provide, for example, one single transversal strut 26 at one longitudinal side of the longitudinal strut 27. Contrary to the disclosure of FIG. 6, the opposite transversal strut 26 may also be arranged in lateral displacement on both sides of the longitudinal strut 27.

Figure 7:
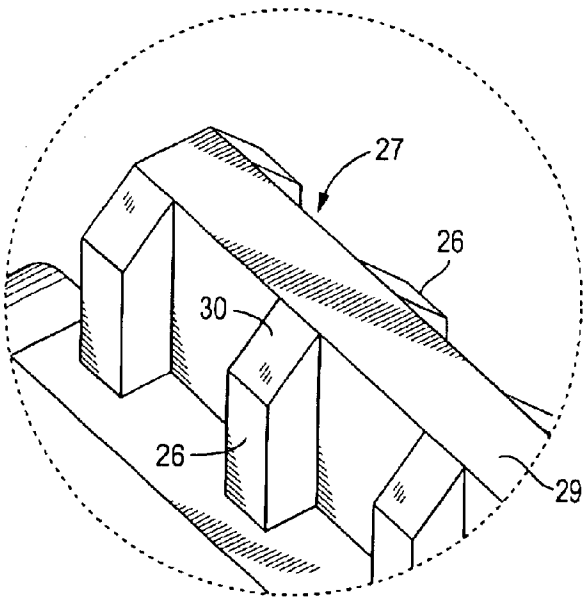
FIG. 7 shows in detail the transversal strut.

FIG. 7 shows a corresponding enlarged view of the longitudinal strut 27 with two transversal struts 26. The advantage of the slanted plane 30 of the transversal strut 26 is the fact that when the first and the second locking runner 21, 22 are pressed with the slanted plane 30 through the partition layer 15, the partition layer 15 can either be pressed apart or cut open more easily. On the whole, the slanted plane 30 makes it easier to press the further switching relay 20 into the partition layer 15, thereby achieving an easier fixing of the further switching relay 20 to the base member plate 23. The first and second locking runners 21, 22 are preferably in one piece with the relay casing 28. As a preferred material for the construction of the relay casing as well as for the first and second locking runner 21, 22, use is made of synthetics.

Figure 8:
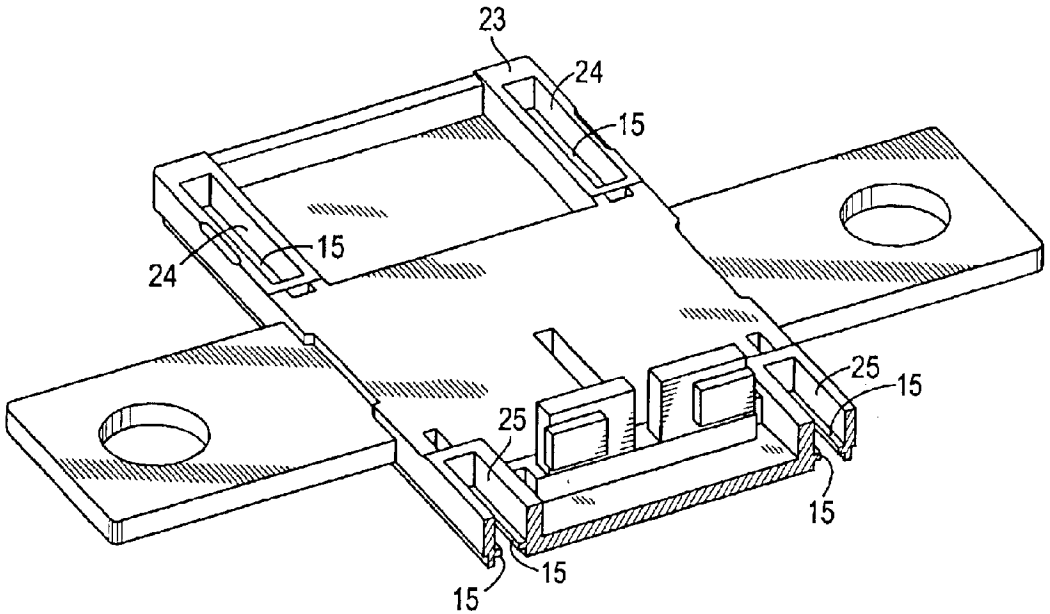
FIG. 8 is a base member plate with shafts and partition layers at the side walls of the shafts.

FIG. 8 is a top view of the base member plate 23 and clearly shows the first and second shafts 24, 25. For better representation, the two shafts 25 are cut open in order to allow for a clear view of partition layers 15, which are arranged alongside the longitudinal sides of the first and second shafts 24, 25. The partition layers 15 are layers which extend from the longitudinal sides of the first and the second shafts 24, 25 in the direction of the opposite longitudinal side. The two opposite partition layers 15 of a first or second shaft 24, 25 have a fixed distance to each other.

Depending on the embodiment, the partition layer 15 may also be provided at only one longitudinal side of a shaft 24, 25. In another embodiment, the partition layer seals the entire shaft 24, 25 in the shape of a plane. In this embodiment, the locking runners 21, 22 at least partially enter the partition layer 15 when pressing down the further relay 20 while fixing it to the base member plate 23. Depending on the embodiment, the partition layer 15 may also be cut up when the further relay 20 is pressed down.

We claim:

1. An electromagnetic switching relay, comprising:

a base member having first guide elements and terminals with contact faces thereon;

a magnetized coil having second guide elements;

an armature having contacts faces thereon, the armature moveable by magnetizing the magnetized coil to form and break contact between the contact faces on the base member and the contact faces on the armature; and a partition layer positioned adjacent to the first guide elements;

the partition layer having a first state wherein the second guide elements are in sliding engagement with the first guide elements when the base member and the magnetized coil are not biased together, and a second state wherein the partition layer is irreversibly altered by the second guide elements to form a locking engagement with the first guide elements when the base member and the magnetized coil are biased together.

2. The electromagnetic switching relay of claim 1, wherein the partition layer is a film skin disposed between the first guide elements and the second guide elements.

3. The electromagnetic switching relay of claim 1, wherein the partition layer irreversibly deformed when the base member and the magnetized coil are biased together.

4. The electromagnetic switching relay of claim 1, wherein the partition layer si partially severed when the base member and the magnetized coil are biased together.

5. The electromagnetic switching relay of claim 1, wherein the first guide elements are slots and the second guide elements are further fixed by applying a hardening material in the first guide elements.

6. The electromagnetic switching relay of claim 1, wherein the first guide elements are formed as shafts and extend in a longitudinal direction with respect to the base member, and the second guide elements are formed as runners on a lower side of the magnetising coil facing the base member to engage the shafts of the base member.

7. The electromagnetic switching relay of claim 6, wherein the partition layer is in the second state and the first guide elements and the second guide elements are further fixed by applying a hardening material to the first guide elements.

8. An electromagnetic switching relay, comprising:

a base member having first guide elements formed as slots that extend in a longitudinal direction with respect to the base member;

a magnetized coil having second guide elements formed as runners on a lower side of the magnetizing coil that face the base member and engage the first guide elements; and a partition layer positioned adjacent to the first guide elements that allows displacement of the magnetizing coil relative to the base member in the longitudinal direction; the partition layer being configured to be irreversibly deformed or partially torn upon biasing together the base member and the magnitized coil to fix the magnetized coil relative to the base member in the longitudinal direction.

9. The electromagnetic switching relay of claim 8, wherein the partition layer is a film skin.

10. The electromagnetic switching relay of claim 8, wherein the partition layer is configured to be irreversibly deformed when the second guide elements and the first guide elements are biased together.

11. The electromagnetic switching relay of claim 8, wherein the partition layer is configured to be partially severed when the second guide elements and the first guide elements are biased together.

12. The electromagnetic switching relay of claim 8, wherein the base member and the magnitized coil are biased together fixing the magnatized coil relative to the base member in the longitudinal direction and the first guide elements and the second guide elements are further fixed by a hardening material applied to the first guide elements.

* * * * *